United States Patent [19]

Vallally

[11] Patent Number: 4,646,843

[45] Date of Patent: Mar. 3, 1987

[54] RETRIEVAL DEVICE

[76] Inventor: Cecil O. Vallally, Princess Way, Low Prudhoe, Northumberland NE42 3PQ, England

[21] Appl. No.: 774,891

[22] Filed: Sep. 11, 1985

[30] Foreign Application Priority Data

Sep. 15, 1984 [GB] United Kingdom ..... 8423365

[51] Int. Cl.[4] ..... E21B 43/12

[52] U.S. Cl. ..... 166/372; 175/236; 175/245

[58] Field of Search ..... 166/369, 162, 202, 372; 175/59, 245, 251, 309, 236, 239; 175/242, 249

[56] References Cited

U.S. PATENT DOCUMENTS

| | | | |
|---|---|---|---|
| 2,646,845 | 7/1953 | Schillinger | 166/202 |
| 2,649,710 | 12/1948 | Dale | 166/202 |
| 2,670,800 | 3/1954 | Stohn | 175/239 |
| 2,672,200 | 3/1950 | Patterson | 166/202 |
| 2,890,756 | 6/1959 | Middleton | 166/162 |
| 3,807,234 | 4/1974 | Duperon | 175/249 |
| 3,874,465 | 4/1975 | Young et al. | 175/236 |

*Primary Examiner*—James A. Leppink
*Assistant Examiner*—Terry Lee Melius
*Attorney, Agent, or Firm*—Cushman, Darby & Cushman

[57] ABSTRACT

A retrieval device, suitable among other uses for lifting solid and liquid materials from underground locations, comprises a generally cylindrical section, a plurality of projecting members extending from said generally cylindrical section and hinged or otherwise flexibly secured thereto so as to be capable of movement between a first position in which they are aligned with the surface of said generally cylindrical section and a second position in which they are inclined inwards towards the axis of the cylinder, and flexible webs extending between adjacent projecting members.

3 Claims, 4 Drawing Figures

RETRIEVAL DEVICE

The present invention is a retrieval device which is of value for lifting solid and liquid materials from underground locations. It may be used, among other applications, for taking samples of granular or stony soils or for lifting oil or water from wells.

In the sampling of soils and clays in percussive boring and rotary drilling operations, the desired objective is to retain an undisturbed sample within the cutting shoe or bit during withdrawal of the latter. Unfortunately it frequently happens that the sample tube proves to be empty when it is withdrawn. Since such abortive sampling attempts represent a frustrating waste of valuable time and labour, attempts have been made to improve the frequency of sample retention by the provision of suitable retainers. Thus I have described in my European Patent Publication No. 0141617 a geotechnical device which has proved to be highly effective in improving the retention frequency of samples of clays and silts of various types.

The sampling of soils which contain stones and of granular soils or gravels requires a different approach. In particular it is important not to limit unduly the size of the maximum aperture of the cutting shoe during the cutting operation but at the same time a positive retention of the sample is required during the withdrawal step. Devices which have been proposed to meet this need include the well-known Shell/Bailer, which in essence is a hinged disc which straddles the sampling aperture. Unfortunately, such devices have hitherto been of such a type that the effective maximum aperture is reduced when they are fitted.

It is therefore one object of my present invention to provide an improved sample retainer for use in the sampling of granular and stony soils and grounds. However the applicability of the retrieval device which I have invented is not confined to retrieving such solid samples. My device is also of particular value for the recovery of oil or water from underground locations, without the need for conventional mechanical pumps.

The retrieval device according to my invention comprises a generally cylindrical section, a plurality of projecting members extending from said generally cylindrical section and hinged or otherwise flexibly secured thereto so as to be capable of movement between a first position in which they are aligned with the surface of said cylindrical section and a second position in which they are inclined inwards towards the axis of the cylinder, and flexible webs extending between adjacent projecting members.

In use, the retrieval device according to my invention is placed in the desired underground location either by fitting it within the cutting shoe of a sampling drill of the percussive type or by mounting it in a suitably weighted holder, with the axis of the retrieval device aligned with that of the cutting shoe or of the well and with the projecting members extending generally upwards from the cylindrical section. As the device enters the material to be retrieved, for example the soil to be sampled or the oil or water to be lifted, the material passes freely through the cylindrical section. On subsequent lifting of the device, the projecting members move inwards under the weight of the material to be retrieved and they together form a barrier to loss of the retrieved material. The webs between the projecting members help to keep those members in appropriate relative alignment and also assist the closing action of the device.

The generally cylindrical section of the retrieving device is preferably made of a rigid or semi-rigid material, for example of steel, an alloy or a suitable plastics material, for example polyurethane. It is conveniently relatively short in an axial direction and should preferably be thin in a radial direction so as to maximise the retrieval aperture.

The projecting members may be parallel-sided, in which case they should be spaced apart around the circumference of the cylindrical section so as to allow for the webs between them. However, I much prefer that the projecting members be tapered in the direction away from the cylindrical section. For example, the projecting members may each be triangular, being then flexibly secured to the cylindrical section at the base of the triangle.

Particularly when the projecting members are tapered in this way, they may, in their inwardly-inclined position, combine to form a multangular (that is, polygonal in section) generally conical barrier. If the projecting members are curved, they may form a true cone. In either case, the apex of the cone preferably encloses an angle of between 40 and 160 degrees, in particular an angle of between 70 and 110 degrees. I particularly prefer that the angle enclosed by the top of the cone be of about 90 degrees.

The hinging of the projecting members to the cylindrical section may be a simple mechanical hinging but it is much preferred either that the projecting members be formed integral with the cylindrical section, the hinges then being lines of flexibility in the material of manufacture, or alternatively that the projecting members be joined to the cylindrical section by hinges of flexible material.

The number of projecting members may be chosen as desired. However I prefer to use at least three such members and there is little to be gained by having more than ten of them. Conveniently the retrieval device comprises five, six, seven or eight projecting members, with six and eight being particularly preferred numbers.

Extending between the projecting members are the flexible webs. Preferably these webs are themselves made of an inherently flexible material but alternatively the flexibility may be achieved, or enhanced, by the provision of folds or creases in the webs.

In one form of my invention, the cylindrical section and the projecting members are formed of a rigid polyvinyl chloride (PVC), while the webs are formed of a flexible PVC. In a preferred version of that form of my invention, the hinges are also of a flexible PVC. Thus in one embodiment, the webs and the hinges are together formed from a single, generally cylindrical sheet of flexible PVC, to which both the rigid PVC cylindrical section and the rigid PVC projecting members are secured, for example by adhesive or thermal bonding.

In another form of my invention, the device is formed either as a single unit of polyurethane or of the same material in two pieces.

My invention will now be further described with reference to the accompanying drawings, in which.

Figure 1:
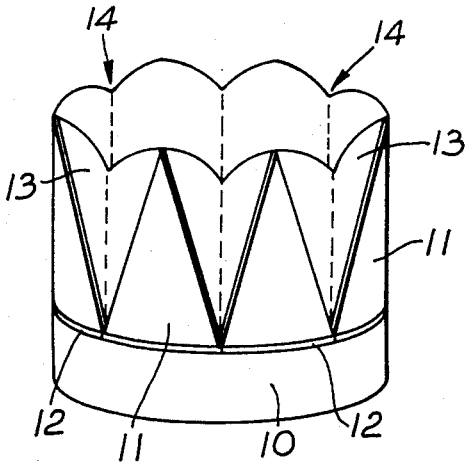
FIG. 1 illustrates in perspective view one embodiment of my invention in an "open" position.
Figure 2:
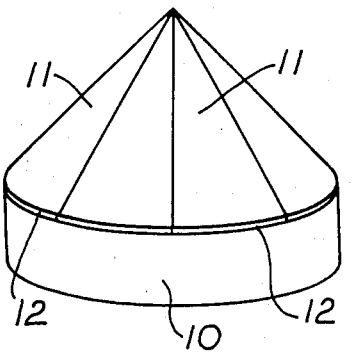
FIG. 2 is a view corresponding to FIG. 2 but with the device in a "closed" position.

The device shown in FIGS. 1 and 2 comprises a cylindrical section 10 with six triangular members 11 extending upwardly from the upper circumference of the section 10. The members 11 are hinged to the section 10 at their lower edges (at 12) and are therefore able to pivot about the hinges 12 from an essentially vertical position (FIG. 1) to an inwardly-inclined position (FIG. 2). The section 10 and the members 11 are made of rigid PVC.

Bridging the gaps between adjacent members 11 are webs 13 of flexible PVC. The webs in the illustrated embodiment are deep enough to fill fairly comprehensively the spaces between the members 11 but are each cut away at 14 to avoid impeding the closing action of the device.

The illustrated device may be used for sample retrieval and then is fitted within or behind the cutting shoe in, for example, a percussive sampling operation, with the members 11 upwards. As the cutting shoe penetrates the soil or gravel, the latter passes without impediment through the retainer into a sampling tube located above it. The internal diameter of the section 10 is only slightly less than its external diameter. In the illustrated embodiment that internal diameter is 10 cm but clearly the retainer may be of any size for which a cutting shoe is available.

When the percussive stroke is completed and the cutting shoe is withdrawn, the members 11 pivot inwardly about the hinges 12, under pressure of the sample on the members 11 and the web 13, until the retainer adopts the closed position shown in FIG. 2. In this position, the members 11 cooperate to form a conical barrier which effectively seals the sample within the sample tube. In the illustrated embodiment the conical barrier encloses an upper angle of about 80 degrees.

The retainer illustrated in FIGS. 1 and 2 may be made in various ways. Thus the section 10 and the members 11 may be formed in a single generally cylindrical piece incorporating thinner or otherwise more flexible sections forming the hinges 12. The webs 13 may then be added individually. A preferred method of manufacture is to form the webs 13 from a single cylindrical piece of flexible sheet material and then to secure the section 10 and the members 11 thereto, for example by means of adhesive. The hinges 12 are in that case afforded by the inherent flexibility of the sheet material.

Figure 3:
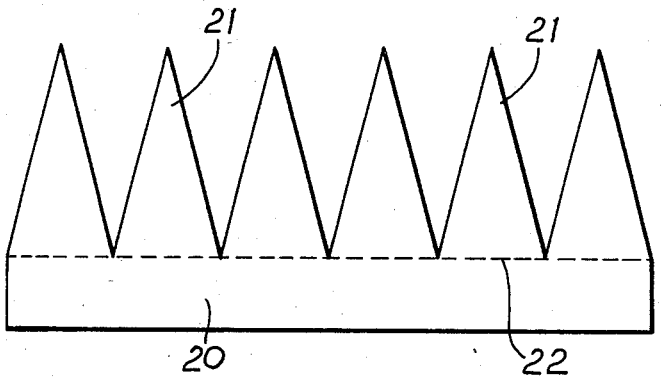
FIG. 3 illustrates a blank suitable for incorporation in an alternative embodiment of my invention.

FIG. 3 illustrates yet another way of making the retrieval device. The Figure shows a flat blank of semi-rigid material which may be shaped, by bending end-to-end, into a cylindrical form consisting of a cylindrical section 20 and projecting members 21, pivotally joined to the section 20 along a crease line 22. The device may be made by securing the blank to a cylindrical sheet of flexible material which serves as the webs between the members 21.

Figure 4:
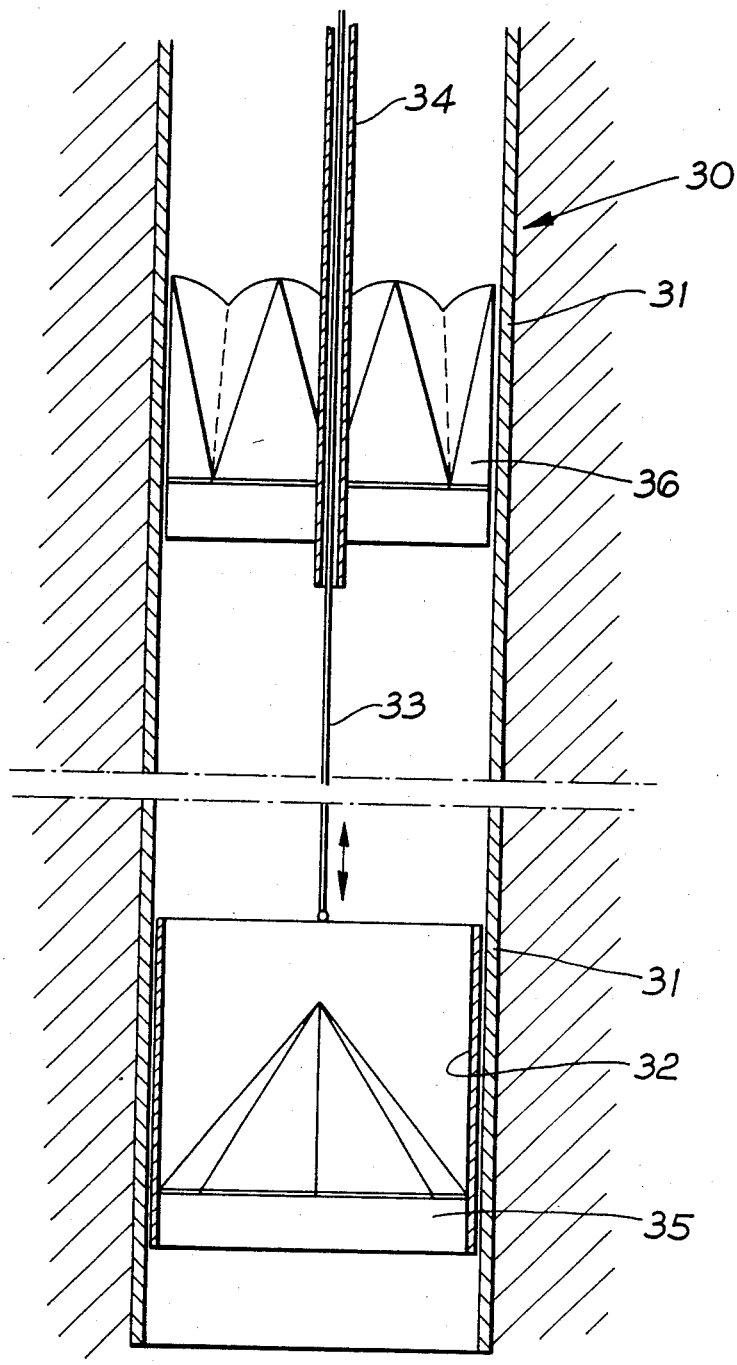
FIG. 4 illustrates schematically the use of my retrieval device for lifting oil or water from a well.

Referring now to FIG. 4 of the drawings, an underground well 30 is shown as being lined with tubular casing 31. Within the well 30, a heavy cylindrical lifter shell 32 is suspended on the lower end of a line 33 passing down an axially located tube 34. Within the shell 32 is a retrieval device 35 according to the invention such as that illustrated in FIGS. 1 and 2. The function of the shell 32 is to locate the device 35 axially in the well and to add weight to the device.

At a higher level in the well 30 are one or more further retrieval devices 36 generally similar to the device 35. The number of such further devices 36 is determined by the depth of the well as will appear hereinafter.

The devices 35 and 36 operate to allow water to be raised from the well without the use of conventional mechanical pumps. The device 35 is first lowered upon the line 33 to below the water level and then lifted. As the device is lowered the projecting members open to allow water to pass axially through the device. When it is subsequently lifted, the members close and water is retained by the device 35 and lifted with it. During this lifting operation, water passes upwards through the vertically fixed devices 36 and is subsequently retained by them at the end of the lifting. Thus reciprocal lifting and lowering of the shell 32 and retrieval device 35 gives a continuous upward flow of water from the well.

The operation of this system via the line 33 may be effected manually or mechanically. Thus, especially in areas where mechanical maintenance facilities are scarce, a reliable supply of water may be made independent of such facilities.

By a similar operation, retrieval device according to the invention may be used for the recovery of oil after a well reaches an age where natural oil pressure is inadequate to raise the product to the surface.

In general, the device according to the present invention may for most uses have an overall diameter of between 5 cm and 60 cm, especially between 10 cm and 45 cm. In yet another application, for which its diameter will be at or beyond the lower end of the above range, the device may be used on the domestic front for mixing purposes, in a manner similar to its use for recovering underground liquid deposits.

I claim:

1. A retrieval device, suitable for use in lifting a liquid from within a well, comprising:

(a) a squat, generally cylindrical section;

(b) at least three elongated members projecting from said generally cylindrical section and tapering away therefrom;

(c) said projecting members having web means therebetween and being flexibly secured to said generally cylindrical section for movement between a first position in which they are generally parallel to the axis of said section and aligned with said section and a second position in which they are inclined towards said axis so as together to substantially seal the cylindrical section and together form a sealed cone enclosing an angle from 40 to 160 degrees for lifting said liquid;

(d) said web means comprising flexible webs extending between adjacent pairs of said projecting members and substantially closing the space between said members; and (e) whereby, when said projecting members are in said first position, said members and said webs between them together form a generally cylindrical extension of said cylindrical section.

2. A retrieval device according to claim 1, wherein the projecting members are triangular, the bases of said triangles are in abutment around the circumference of said cylindrical section, and the projecting members in said second position together form a cone enclosing an angle from 70 to 110 degrees.

3. A method for the recovery of a liquid from a well, comprising:

(a) locating at a position generally towards the lower end of said well and below the level of liquid therein a first retrieval device having (i) a generally cylindrical section;

(ii) at least three generally triangular members projecting from said generally cylindrical section;

(iii) flexible webs extending between adjacent pairs of said triangular members and essentially filling the space between said members;

(iv) said generally triangular members being flexibly secured to said generally cylindrical section for movement between a first position in which said members and said webs together form a generally cylindrical extension of said section and a second position in which said members are inclined into mutual contiguous abutment so as to form together a sealed cone containing an angle from 40 to 160 degrees;

(b) locating at least one second such retrieval device at a higher position in said well above the level of liquid therein; and (c) alternately raising and lowering said first retrieval device towards and away from said at least one second retrieval device, thereby moving the liquid upwardly in the well by alternately moving said members of each device between said first and second positions.

* * * * *